US005899177A

United States Patent [19]

Binversie et al.

[11] Patent Number: 5,899,177

[45] Date of Patent: May 4, 1999

[54] FOUR-CYCLE MARINE ENGINE

[75] Inventors: Gregory J. Binversie, Grayslake; George L. Broughton, Zion, both of Ill.; Paul W. Breckenfeld, Kenosha, Wis.; William D. Dunham, Waukegan; Stephen J. Towner, Libertyville, both of Ill.; James A. Nettles, Mountain Home, Ark.

[73] Assignee: Outboard Marine Corporation, Waukegan, Ill.

[21] Appl. No.: 08/947,249

[22] Filed: Oct. 8, 1997

Related U.S. Application Data

[62] Division of application No. 08/610,553, Mar. 6, 1996, Pat. No. 5,738,051.

[51] Int. Cl.[6] ..... F02B 75/22

[52] U.S. Cl. ..... 123/54.4; 123/65 PE; 123/65 A

[58] Field of Search ..... 123/54.4, 190.2, 123/190.1, 585, 65 EM, 65 PE, 65 A, 184.31

[56] References Cited

U.S. PATENT DOCUMENTS

| | | | |
|---|---|---|---|
| 4,276,858 | 7/1981 | Jaulmes | 123/54.4 |
| 4,312,308 | 1/1982 | Slattery | 123/65 A |
| 4,825,843 | 5/1989 | Novy | 123/585 |
| 4,947,807 | 8/1990 | Flaig et al. | 123/54.4 |
| 5,460,555 | 10/1995 | Fukuoka et al. | 123/196 R |
| 5,738,051 | 4/1998 | Binversie et al. | 123/54.4 |
| 5,769,041 | 6/1998 | Suzuki et al. | 123/65 PE |

*Primary Examiner*—John Kwon

*Attorney, Agent, or Firm*—Jones, Day, Reavis & Pogue

[57] ABSTRACT

A cylinder block for an internal combustion engine includes a mounting surface having therein a crankcase cavity and a pair of cylinders respectively extending from the cavity in acute angular relation to each other and each including a cylinder wall. The cylinder walls include outer ends having cylinder head mounting surfaces, mixture transfer ports, mixture supply ports, gas discharge ports and a main exhaust gas discharge passage. A passage communicates between the exhaust gas discharge ports and with the main exhaust gas discharge passage. Mixture supply passages extend between the mounting surface and the cylinder head mounting surfaces and include reed valves. Branch passages communicate between the transfer ports in the cylinder walls and the mixture supply passages at respective locations between the cylinder head mounting surfaces and the reed valves. Auxiliary supply passages extend from the mounting surface and communicate with the mixture supply ports in the cylinder walls.

3 Claims, 1 Drawing Sheet

FOUR-CYCLE MARINE ENGINE

This is a divisional of application Ser. No. 08/610,553 filed on Mar. 6, 1996, now U.S. Pat. No. 5,738,051.

BACKGROUND OF THE INVENTION

The invention relates generally to internal combustion engines, and more particularly, to four-stroke internal combustion engines which are particularly adapted for use in outboard motors.

Attention is directed to the following U.S. Patents:

U.S. Pat. No. 0,908,657, Frayer, et al., issued Jan. 5, 1909
U.S. Pat. No. 1,052,340, Holst, issued Feb. 4, 1913
U.S. Pat. No. 1,126,309, Snyder, issued Jan. 26, 1915
U.S. Pat. No. 1,170,276, Kline, issued Feb. 1, 1916
U.S. Pat. No. 1,194,722, Davol, issued Aug. 15, 1916
U.S. Pat. No. 1,218,487, Storle, issued Mar.6, 1917
U.S. Pat. No. 1,234,039, Kessler, issued Jul. 17, 1917
U.S. Pat. No. 1,396,045, Mellen, issued Nov. 8, 1921
U.S. Pat. No. 1,396,418, Gilliard, issued Nov. 8, 1921
U.S. Pat. No. 1,504,093, Burtnett, issued Aug. 5, 1924
U.S. Pat. No. 1,510,651, Burtnett, issued Oct. 7, 1924
U.S. Pat. No. 1,519,814, Trask, issued Dec. 16, 1924
U.S. Pat. No. 1,833,802, Violet, issued Nov. 24, 1931
U.S. Pat. No. 1,839,420, Setz, issued Jan. 5, 1932
U.S. Pat. No. 1,849,170, Buchi, issued Mar. 15, 1932
U.S. Pat. No. 1,981,610, Bucklen, issed Nov. 2, 1934
U.S. Pat. No. 2,067,715, Kylén, issued Jan. 12, 1937
U.S. Pat. No. 2,811,149, Tirloni, issued Oct. 29, 1957
U.S. Pat. No. 2,895,459, Sbaiz, issued Jul. 21, 1959
U.S. Pat. No. 2,975,774, Coffey et al., issued Mar. 21, 1961
U.S. Pat. No. 2,989,955, Dunne, issued Jun. 27, 1961
U.S. Pat. No. 3,301,236, Bratton, issued Jan. 31, 1967
U.S. Pat. No. 3,526,216, Henvaux, issued Sep. 1, 1970
U.S. Pat. No. 3,613,646, Hisada, issued Oct. 19, 1971
U.S. Pat. No. 3,730,161, Deane, issued May 1, 1973
U.S. Pat. No. 3,859,968, Stinebaugh, issued Jan. 14, 1975
U.S. Pat. No. 3,905,344, Villella, issued Sep. 16, 1975
U.S. Pat. No. 3,918,420, Villella, issued Nov. 11, 1975
U.S. Pat. No. 3,945,364, Cook, issued Mar. 23, 1976
U.S. Pat. No. 3,948,227, Guenther, issued Apr. 6, 1976
U.S. Pat. No. 3,973,532, Litz, issued Aug. 10, 1976
U.S. Pat. No. 3,989,025, Franco, issued Nov. 2, 1976
U.S. Pat. No. 4,007,725, Weaver, issued Feb. 15, 1977
U.S. Pat. No. 4,016,840, Lockshaw, issued Apr. 12, 1977
U.S. Pat. No. 4,036,184, Guenther, issued Jul. 19, 1977
U.S. Pat. No. 4,098,237, Suquet, issued Jul. 4, 1978
U.S. Pat. No. 4,108,119, McWhorter, issued Aug. 22, 1978
U.S. Pat. No. 4,116,189, Asaga, issued Sep. 26, 1978
U.S. Pat. No. 4,134,381, Little, issued Jan. 16, 1979
U.S. Pat. No. 4,160,436, Flower, issued Jul. 10, 1979
U.S. Pat. No. 4,169,434, Guenther, issued Oct. 2, 1979
U.S. Pat. No. 4,248,199, Mcwhorter, issued Feb. 3, 1981
U.S. Pat. No. 4,312,313, McWhorter, issued Jan. 26, 1982
U.S. Pat. No. 4,426,967, Mcwhorter, issued Jun. 24, 1984
U.S. Pat. No. 4,473,041, Lyons et al., issued Sep. 25, 1984

U.S. Pat. No. 4,574,749, Negre, issued Mar. 11, 1986
U.S. Pat. No. 4,735,186, Parsons, issued Apr. 5, 1988
U.S. Pat. No. 4,739,737, Kruger, issued Apr. 26, 1988
U.S. Pat. No. 4,788,945, Negre, issued Dec. 6, 1988
U.S. Pat. No. 4,852,532, Bishop, issued Aug. 1, 1989
U.S. Pat. No. 4,858,577, Matsuura et al., issued Aug. 22, 1989
U.S. Pat. No. 4,864,985, Slee, issued Sep. 12, 1989
U.S. Pat. No. 4,920,934, Pizzicara, issued May 1, 1990
U.S. Pat. No. 4,926,809, Allen, issued May 22, 1990
U.S. Pat. No. 4,949,685, Doland et al., issued Aug. 21, 1990
U.S. Pat. No. 4,953,527, Coates, issued Sep. 4, 1990
U.S. Pat. No. 4,989,576, Coates, issued Feb. 5, 1991
U.S. Pat. No. 5,052,349, Buelna, issued Oct. 1, 1991

SUMMARY OF THE INVENTION

The invention provides a four-stroke internal combustion engine comprising a common crankcase, a crankshaft extending in the crankcase, first and second cylinders respectively extending from the common crankcase in acute angular relation to each other and respectively including first and second cylinder walls respectively including first and second exhaust gas discharge ports, a passage connecting the first and second exhaust gas discharge ports, first and second pistons respectively located in the first and second cylinders and respectively connected to the crankshaft for reciprocating movement toward and away from the crankshaft and between top dead center and bottom dead center positions, first and second cylinder heads respectively connected to the first and second cylinders, respectively partially defining first and second combustion chambers, and respectively including first and second mixture inlet passages respectively communicating with the first and second combustion chambers, first and second exhaust gas outlet passages respectively communicating with the first and second combustion chambers, and first and second rotary valves respectively located in the first and second mixture inlet passages and in the first and second exhaust gas outlet passages, first and second primary carburetors adapted to form fuel/air mixtures, and first and second mixture supply passages respectively communicating with the first and second primary carburetors and with the first and second mixture inlet passages and respectively including therein first and second reed valves.

The invention also provides a four-stroke internal combustion engine comprising a common crankcase, a crankshaft extending in the crankcase, first and second cylinders respectively extending from the common crankcase in acute angular relation to each other and respectively including first and second cylinder walls respectively including first and second mixture transfer ports, first and second pistons respectively located in the first and second cylinders, respectively connected to the crankshaft for reciprocating movement toward and away from the crankshaft and between top dead center and bottom dead center positions, and respectively including first and second mixture transfer ports located for communication with the first and second mixture transfer ports in the cylinder walls when the first and second pistons are adjacent the bottom dead center positions, and first and second cylinder heads respectively connected to the first and second cylinders, respectively partially defining first and second combustion chambers, and respectively including first and second mixture inlet passages respectively communicating with the first and second combustion chambers, first and second exhaust gas outlet passages respectively communicating with the first and second combustion chambers, and first and second rotary valves respectively located in the first and second mixture inlet passages and in the first and second exhaust gas outlet passages, first and second primary carburetors adapted to form fuel/air mixtures, first and second mixture supply passages respectively communicating with the first and second primary carburetors and with the first and second mixture inlet passages and respectively including therein first and second reed valves, and first and second branch passages respectively communicating between the first and second mixture transfer ports in the cylinder walls and the first and second mixture supply passages at respective locations between the first and second reed valves and the first and second mixture inlet passages.

The invention also provides a four-stroke internal combustion engine comprising a common crankcase, a crankshaft extending in the crankcase, first and second cylinders respectively extending from the common crankcase in acute angular relation to each other and respectively including first and second cylinder walls respectively including first and second exhaust gas discharge ports, first and second mixture transfer ports, and first and second mixture supply ports, a passage connecting the first and second exhaust gas discharge ports, first and second pistons respectively located in the first and second cylinders, respectively connected to the crankshaft for reciprocating movement toward and away from the crankshaft and between top dead center and bottom dead center positions, and respectively including first and second mixture transfer ports located for communication with the first and second mixture transfer ports in the cylinder walls when the first and second pistons are adjacent the bottom dead center positions, and first and second mixture supply ports respectively located for communication with the first and second mixture supply ports in the cylinder walls when the first and second pistons are adjacent the top dead center positions, first and second cylinder heads respectively connected to the first and second cylinders, respectively partially defining first and second combustion chambers, and respectively including first and second mixture inlet passages respectively communicating with the first and second combustion chambers, first and second exhaust gas outlet passages respectively communicating with the first and second combustion chambers, and first and second rotary valves respectively located in the first and second mixture inlet passages and in the first and second exhaust gas outlet passages, first and second primary carburetors adapted to form fuel/air mixtures, first and second mixture supply passages respectively communicating with the first and second primary carburetors and with the first and second mixture inlet passages and respectively including therein first and second reed valves, first and second branch passages respectively communicating between the first and second mixture transfer ports in the cylinder walls and the first and second mixture supply passages at respective locations between the first and second reed valves and the first and second mixture inlet passages, first and second auxiliary carburetors adapted to form fuel/air mixtures, and first and second auxiliary supply passages respectively communicating between the first and second auxiliary carburetors and the first and second mixture supply ports in the cylinder walls.

The invention also provides a four-stroke internal combustion engine comprising an engine block assembly comprising a cylinder block including a mounting surface having therein a crankcase cavity, and first and second cylinders respectively extending from the crankcase cavity in acute angular relation to each other and respectively including first and second cylinder walls respectively including first and second outer ends having respective first and second cylinder head mounting surfaces, first and second exhaust gas discharge ports, a main exhaust gas discharge passage, a passage communicating between the first and second exhaust gas discharge ports and with the main exhaust gas discharge passage, first and second mixture supply passages respectively extending between the mounting surface and the first and second cylinder head mounting surfaces and respectively including therein first and second reed valves, a crankcase cover fixed to the cylinder block and defining, with the cylinder block, a common crankcase, first and second cylinder heads respectively fixed to the first and second cylinder head mounting surfaces of the first and second cylinders, respectively at least partially defining first and second combustion chambers, and respectively including first and second mixture inlet passages respectively communicating between the first and second combustion chambers and the first and second mixture supply passages, first and second exhaust gas outlet passages respectively communicating with the first and second combustion chambers, and first and second rotary valves respectively located in the first and second mixture inlet passages and in the first and second exhaust gas outlet passages, a crankshaft extending in the crankcase, first and second pistons respectively located in the first and second cylinders and respectively connected to the crankshaft for reciprocating movement toward and away from the crankshaft and between top dead center and bottom dead center positions, and first and second primary carburetors mounted on the mounting surface in respective communication with the first and second mixture supply passages and adapted to form fuel/air mixtures.

The invention also provides a four-stroke internal combustion engine comprising an engine block assembly comprising a cylinder block including a mounting surface having therein a crankcase cavity, and first and second cylinders respectively extending from the crankcase cavity in acute angular relation to each other and respectively including first and second cylinder walls respectively including first and second outer ends having respective first and second cylinder head mounting surfaces, and first and second mixture transfer ports, first and second mixture supply passages respectively extending between the mounting surface and the first and second cylinder head mounting surfaces and respectively including therein first and second reed valves, and first and second branch passages respectively communicating between the first and second mixture transfer ports in the cylinder walls and the first and second mixture supply passages at respective locations between the first and second cylinder head mounting surfaces and the first and second reed valves, a crankcase cover fixed to the cylinder block and defining, with the cylinder block, a common crankcase, first and second cylinder heads respectively fixed to the first and second cylinder head mounting surfaces of the first and second cylinders, respectively at least partially defining first and second combustion chambers, and respectively including first and second mixture inlet passages respectively communicating between the first and second combustion chambers and the first and second mixture supply passages, first and second exhaust gas outlet passages respectively communicating with the first and second combustion chambers, and first and second rotary valves respectively located in the first and second mixture inlet passages and in the first and second exhaust gas outlet passages, a crankshaft extending in the crankcase, first and second pistons respectively located in the first and second cylinders, respectively connected to the crankshaft for reciprocating movement toward and away from the crankshaft and between top dead center and bottom dead center positions, and respectively including first and second mixture transfer ports located for communication with the first and second mixture transfer ports in the cylinder walls when the first and second pistons are adjacent the bottom dead center positions, and first and second primary carburetors mounted on the mounting surface in respective communication with the first and second mixture supply passages and adapted to form fuel/air mixtures.

The invention also provides a four-stroke internal combustion engine comprising an engine block assembly comprising a cylinder block including a mounting surface having therein a crankcase cavity, and first and second cylinders respectively extending from the crankcase cavity in acute angular relation to each other and respectively including first and second cylinder walls respectively including first and second outer ends having respective first and second cylinder head mounting surfaces, first and second exhaust gas discharge ports, first and second mixture transfer ports, and first and second mixture supply ports, a main exhaust gas discharge passage, a passage communicating between the first and second exhaust gas discharge ports and with the main exhaust gas discharge passage, first and second mixture supply passages respectively extending between the mounting surface and the first and second cylinder head mounting surfaces and including first and second reed valves, first and second branch passages respectively communicating between the first and second mixture transfer ports in the cylinder walls and the first and second mixture supply passages at respective locations between the first and second cylinder head mounting surfaces and the first and second reed valves, and first and second auxiliary supply passages respectively extending from the mounting surface and communicating with the first and second mixture supply ports in the cylinder walls, a crankcase cover fixed to the cylinder block and defining, with the cylinder block, a common crankcase, first and second cylinder heads respectively fixed to the first and second cylinder head mounting surfaces of the first and second cylinders, respectively at least partially defining first and second combustion chambers, and respectively including first and second mixture inlet passages respectively communicating between the first and second combustion chambers and the first and second mixture supply passages, first and second exhaust gas outlet passages respectively communicating with the first and second combustion chambers, and first and second rotary valves respectively located in the first and second mixture inlet passages and in the first and second exhaust gas outlet passages, a crankshaft extending in the crankcase, first and second pistons respectively located in the first and second cylinders, respectively connected to the crankshaft for reciprocating movement toward and away from the crankshaft and between top dead center and bottom dead center positions, and respectively including first and second mixture transfer ports located for communication with the first and second mixture transfer ports in the cylinder walls when the first and second pistons are adjacent the bottom dead center positions, and first and second mixture supply ports located for communication with the first and second mixture supply ports in the cylinder walls when the first and second pistons are adjacent the top dead center positions, first and second primary carburetors mounted on the mounting surface in respective communication with the first and second mixture supply passages and adapted to form fuel/air mixtures, and first and second auxiliary carburetors mounted on the mounting surface in respective communication with first and second auxiliary supply passages and adapted to form fuel/air mixtures.

The invention also provides a cylinder head comprising a one-piece casting including a planar mounting surface adapted to be fixed on a cylinder block, a surface defining a recess located in the planar mounting surface and adapted to form a part of a combustion chamber, and an internal fuel/air mixture inlet passage having a first end communicating with the recess, and a second end located in the surface, and an internal exhaust gas discharge passage having a first end communicating with the recess, and a second end located in the surface.

The invention also provides a cylinder block comprising a mounting surface having therein a crankcase cavity, and first and second cylinders respectively extending from the crankcase cavity in acute angular relation to each other and respectively including first and second cylinder walls respectively including first and second outer ends having respective first and second cylinder head mounting surfaces, first and second exhaust gas discharge ports, a main exhaust gas discharge passage, a passage communicating between the first and second exhaust gas discharge ports and with the main exhaust gas discharge passage, and first and second mixture supply passages respectively extending between the mounting surface and the first and second cylinder head mounting surfaces and respectively including therein first and second reed valves.

The invention also provides a cylinder block comprising a mounting surface having therein a crankcase cavity, and first and second cylinders respectively extending from the crankcase cavity in acute angular relation to each other and respectively including first and second cylinder walls respectively including first and second outer ends having respective first and second cylinder head mounting surfaces, and first and second mixture transfer ports, one of the first and second cylinder walls including a mixture supply port, first and second mixture supply passages respectively extending between the mounting surface and the first and second cylinder head mounting surfaces and respectively including first and second reed valves, a branch passage communicating between the mixture transfer port in the one of the cylinder walls and the corresponding one of the mixture supply passages at a location between the corresponding one of the first and second cylinder head mounting surfaces and the corresponding one of the first and second reed valves, and an auxiliary supply passage extending from the mounting surface and communicating with the mixture supply port in the one of the first and second cylinder walls.

The invention also provides a cylinder block comprising a mounting surface having therein a crankcase cavity, and first and second cylinders respectively extending from the crankcase cavity in acute angular relation to each other and respectively including first and second cylinder walls respectively including first and second outer ends having respective first and second cylinder head mounting surfaces, first and second mixture transfer ports, first and second mixture supply ports, and first and second exhaust gas discharge ports, a main exhaust gas discharge passage, a passage communicating between the first and second exhaust gas discharge ports and with the main exhaust gas discharge passage, first and second mixture supply passages respectively extending between the mounting surface and the first and second cylinder head mounting surfaces and respectively including first and second reed valves, first and second branch passages respectively communicating between the first and second mixture transfer ports in the cylinder walls and the first and second mixture supply passages at respective locations between the first and second cylinder head mounting surfaces and the first and second reed valves, and first and second auxiliary supply passages respectively extending from the mounting surface and communicating with the first and second mixture supply ports in the cylinder walls.

The invention also provides a piston moveable in a cylinder including a cylindrical wall between top dead center and bottom dead center positions and comprising a skirt including a mixture transfer port adapted for communication with the mixture transfer port in the cylinder wall when the piston is adjacent the bottom dead center position, and a mixture supply port adapted for communication with a mixture supply port in the cylinder wall when the piston is adjacent the top dead center position.

Other features and advantages of the invention will become apparent to those skilled in the art upon review of the following detailed description, claims and drawings.

DESCRIPTION OF THE PREFERRED EMBODIMENT

Figure 1:
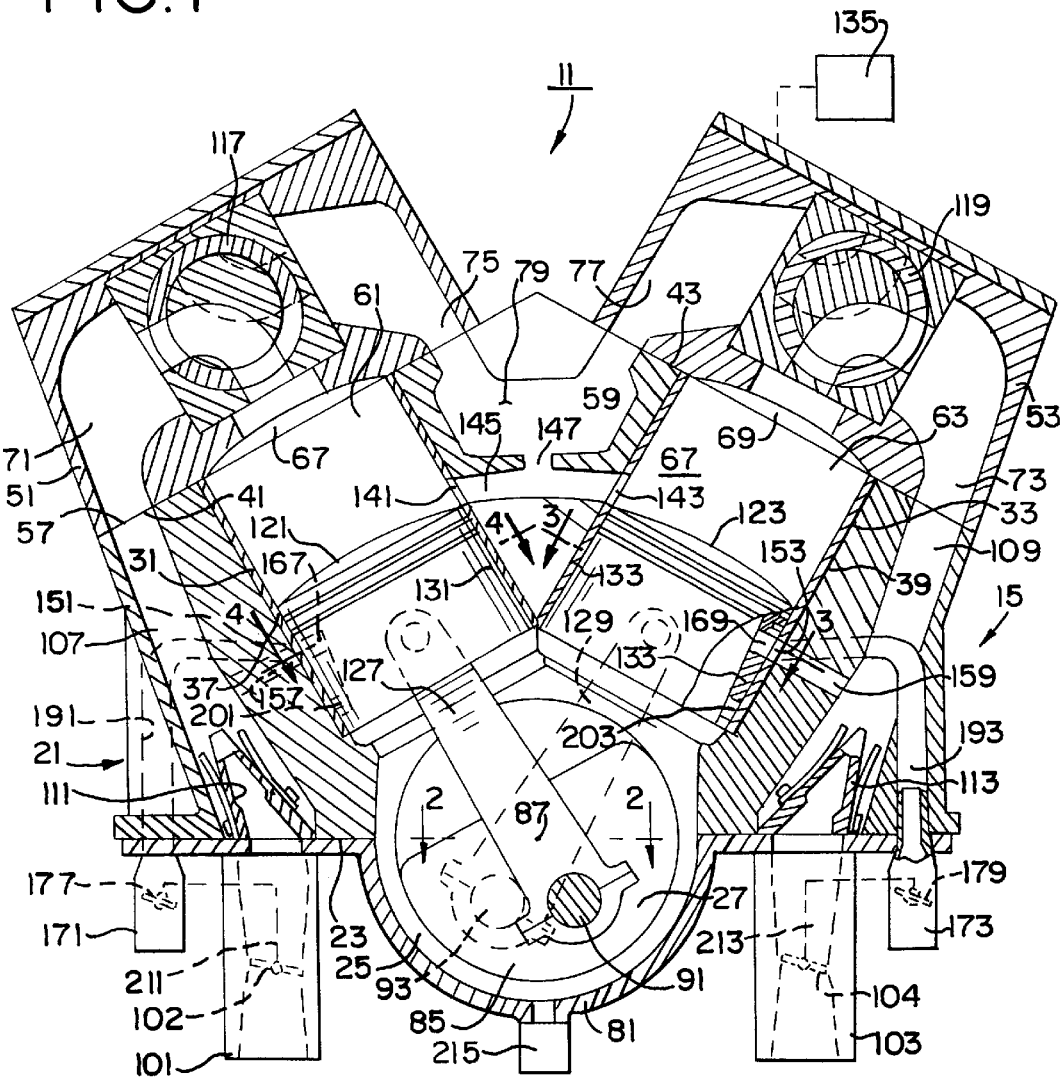
FIG. 1 is a schematic view, partially in section, of an internal combustion engine which embodies various other features of the invention.

Shown schematically in FIG. 1 is a four-stroke internal combustion engine 11 which is especially adapted for marine use and which, in general, employs a four-stroke engine block assembly 15 which is modified to provide two-stoke operational advantages. More specifically, the engine block assembly 15 can be of any suitable construction not inconsistent with the following description and includes a cylinder block 21 which includes a mounting surface 23 having therein a crankcase cavity 25 partially defining a common crankcase 27. The cylinder block 21 also includes first and second cylinders 31 and 33 which extend radially from the crankcase cavity 25 and respectively include first and second cylinder walls 37 and 39. At the outer ends thereof, the first and second cylinders 31 and 33 respectively include first and second cylinder head mounting surfaces 41 and 43.

The engine block assembly 15 also includes first and second cylinder heads 51 and 53 which can be of any suitable construction not inconsistent with the following description and which respectively include first and second planar cylinder block surfaces 57 and 59 which are respectively and suitably connected to the cylinder head mounting surfaces 41 and 43 as to close the first and second cylinders 31 and 33 and, at least partially, respectively define first and second combustion chambers 61 and 63. The first and second cylinder heads 51 and 53 also include therein respective first and second recessed surface portions or combustion chamber recesses 67 and 69.

The first and second cylinder heads 51 and 53 also respectively include first and second mixture inlet passages 71 and 73 respectively communicating between the first and second combustion chamber recesses 67 and 69 and the cylinder block mounting surfaces 57 and 59. The first and second cylinder heads 51 and 53 also respectively include first and second exhaust gas outlet passages 75 and 77 which respectively communicate between the first and second combustion chamber recesses 67 and 69 and the cylinder block mounting surfaces 57 and 59. In turn, the first and second exhaust outlet passages 75 and 77 communicate with a main exhaust gas outlet passage 79 which is suitably formed in the cylinder block 21 and which communicates with the atmosphere.

The engine block assembly 15 also includes a crankcase cover 81 which is suitably connected to the cylinder block mounting surface 23 and which completes the common crankcase 27.

Figure 2:
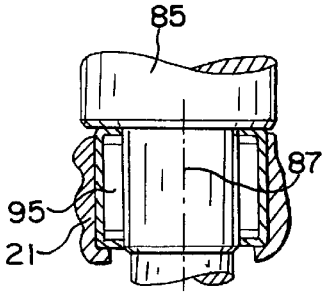
FIG. 2 is a fragmentary sectional view taken along line 2—2 of FIG. 1.

The engine 11 also includes a crankshaft 85 which is supported in the crankcase 27 for rotation about a crankshaft axis 87. Any suitable crankshaft construction including angularly spaced first and second crankpins 91 and 93 can be employed. In the disclosed engine 11, the crankshaft 85 is rotatably supported (see FIG. 2) by suitably axially spaced and suitably constructed and hardened needle bearings or needle bearing assemblies 95 which are supported by the cylinder block 21 and by the crankcase cover 81 in a manner conventional in two-stroke engine construction.

The engine 11 also includes a primary fuel supply system or arrangement including first and second primary carburetors 101 and 103 which are fixed on the crankcase mounting surface 23, which can be of any suitable construction including respective throttle valves 102 and 104, which are adapted to be connected to any suitable source of fuel, and which are adapted to form fuel/air mixtures.

The primary fuel supply system also includes first and second mixture supply passages 107 and 109 which are preferably cast in the cylinder block 21 in generally adjacent relation to the respective cylinders 31 and 33 and which respectively extend between the cylinder block mounting surface 23 and the cylinder head mounting surfaces 41 and 43. The first and second mixture supply passages 107 and 109 respectively communicate, through the mounting surface 23, with the first and second primary carburetors 101 and 103, and, through the cylinder head mounting surfaces 41 and 43, with the first and second mixture inlet passages 71 and 73 in the cylinder heads 51 and 53.

The primary fuel supply system or arrangement also includes first and second reed valves 111 and 113 which are respectively located in the first and second mixture supply passages 107 and 109 downstream from the first and second primary carburetors 101 and 103 so as to permit flow into the mixture supply passages 107 and 109 from the first and second primary carburetors 101 and 103, while preventing outflow from the first and second mixture supply passages 107 and 109 to the first and second primary carburetors 101 and 103.

Control of the flow of the fuel/air mixture to the first and second cylinders 31 and 33, and control of the exhaust gas flow from the cylinders 31 and 33, is provided by respective first and second rotary valves 117 and 119 which are respectively located in the first and second mixture inlet passages 71 and 73, and in the first and second exhaust gas outlet passages 75 and 77 in the cylinder heads 51 and 53. The rotary valves 117 and 119 are rotated in unison with crankshaft rotation by any suitable arrangement, and serve to appropriately open and close the mixture inlet passages 71 and 73 and the exhaust gas outlet passages 75 and 77 so as to control flow of the fuel/air mixture through the mixture inlet passages 71 and 73 to the combustion chambers 61 and 63, and so as to control flow of exhaust gasses through the first and second exhaust gas outlet passages 75 and 77 from the combustion chambers 61 and 63, in sequence, as is commonly known, with respect to four-stroke engine construction. Any suitable rotary valve construction can be employed.

The engine 11 also includes first and second pistons 121 and 123 which are respectively connected to the first and second crankpins 91 and 93 by suitable connecting rods 127 and 129, and which are respectively reciprocally movable in the first and second cylinders 31 and 33 toward and away from the crankshaft 27 and between top dead center and bottom dead center positions. The first and second pistons 121 and 123 can be of any suitable construction, except as hereinafter explained, and respectively include first and second skirts 131 and 133 which respectively wipe the first and second cylinder walls 37 and 39.

The engine 11 also includes a schematically shown ignition system 135 which can be of any suitable construction, which is operatively connected to first and second spark plugs (not shown) respectively extending into the first and second combustion chambers 61 and 63, and which is operable to alternately fire the first and second spark plugs at intervals of about 360° of crankshaft rotation, whereby the first and second spark plugs are alternately fired at each occurrence of the approach of the first and second pistons 121 and 123 to top dead center positions.

The engine 11 also includes an auxiliary tuned exhaust gas discharge system which serves to reduce the thermal load on the rotary valve arrangement and to compact the charge in the crankcase 27 during compression. The auxiliary tuned exhaust gas discharge system includes, in the first and second cylinder walls 37 and 39, respective first and second exhaust gas discharge ports 141 and 143 which are located so as to be respectively uncovered by the first and second pistons 121 and 123, and thereby opened, as the pistons approach bottom dead center, at a point closer to the cylinder bottoms than is usually employed in two-stroke construction.

In addition, the auxiliary tuned exhaust gas discharge system includes a suitable connecting passage 145 which is formed in the cylinder block 21 and which communicates between the first and second exhaust gas discharge ports 141 and 143, thereby facilitating packing of the combustion chambers 61 and 63. In addition, the connecting passage 145 communicates through an exhaust gas passage or conduit 147 with the main exhaust gas outlet passage 79.

Use of the auxiliary tuned exhaust gas discharge system results in discharge through the exhaust gas discharge ports 141 and 143 of a large percentage of the exhaust gas (up to as much as 80 percent) and thereby serves to reduce the temperature of the rotary valves 117 and 119 due to the hot exhaust gas flow, and thereby also serves to reduce excessive oil consumption and to provide increased volumetric efficiency.

The connecting passage 145 of the auxiliary tuned exhaust gas discharge system is arranged so that the first and second cylinders 31 and 33 are pulse tuned by each other. More specifically, when one of the cylinders 31 and 33 is completing the power stroke, the other cylinder is completing the intake stroke. As a result, the outflow of exhaust gas through the auxiliary exhaust gas discharge port 141 or 143 of one of the cylinders 31 and 33 creates a tuning pulse which is received in the other of the cylinders 31 and 33, thereby increasing the pressure in the receiving cylinder. Such exhaust gas pulse tuning advantageously affords, as already pointed out, reduced temperatures at the rotary valves 117 and 119, as well as greater flexibility with respect to exhaust event timing, and power gains due to an increase in the pressure in the receiving cylinder at the close of intake.

The engine 11 also includes an auxiliary fuel/air mixture intake pumping system. While other constructions can be employed, in the disclosed construction, the auxiliary intake pumping system comprises, in the first and second cylinder walls 37 and 39, respective first and second mixture transfer ports 151 and 153. In addition, the auxiliary intake pumping system also comprises, in the cylinder block 21, respective first and second branch transfer mixture passages or mixture conduits 157 and 159 which respectively communicate with the first and second mixture transfer ports 151 and 153 in the cylinder walls 37 and 39 and with the first and second mixture supply passages 107 and 109 at points downstream of the first and second reed valves 111 and 113.

Still further in addition, the auxiliary intake pumping system also includes, in the first and second piston skirts 131 and 133, respective first and second mixture transfer ports 167 and 169 respectively located for communication with the first and second mixture transfer ports 151 and 153 in the cylinder walls 37 and 39 when the first and second pistons 121 and 123 are adjacent the bottom dead center positions.

The engine 11 also includes an auxiliary fuel supply system or arrangement including first and second auxiliary carburetors 171 and 173 which are fixed to the mounting surface 23, which can be of any suitable construction including respective throttle valves 177 and 179, and which are adapted to form suitable fuel/air mixtures. The auxiliary fuel supply system also includes, in the first cylinder wall 37, a mixture supply port 181 and, in the second cylinder wall 39, a mixture supply port 183. In addition, the auxiliary fuel supply system also includes, in the cylinder block 21, first and second auxiliary mixture supply passages 191 and 193 respectively communicating between the first and second auxiliary carburetors 171 and 173 and the auxiliary mixture supply ports 181 and 183.

The auxiliary fuel supply system also includes, in the first piston 121, a mixture supply port 201, and, in the second piston 123, a mixture supply port 203, which mixture supply ports 201 and 203 communicate with the mixture supply ports 181 and 183 in the cylinder walls 37 and 39 when the pistons 121 and 123 are adjacent top dead center.

Figure 4:
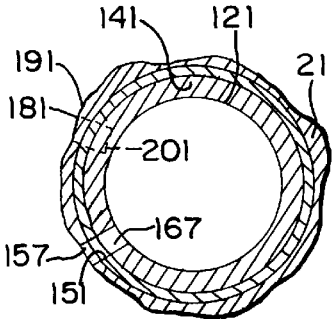
FIG. 4 is a fragmentary sectional view taken along line 4—4 of FIG. 1.
Figure 3:
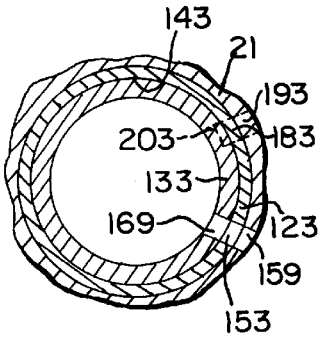
FIG. 3 is a fragmentary sectional view taken along line 3—3 of FIG. 1.

The mixture supply ports 201 and 203 and the mixture transfer ports 167 and 169 are located, as shown in FIG. 1, in axially spaced relation to each other and, as shown in FIGS. 3 and 4, in angularly spaced relation to each other.

The auxiliary fuel supply system provides fuel/air mixture to the common crankcase 27 when the pistons 121 and 123 are adjacent top dead center by affording mixture flow from the auxiliary carburetors 171 and 173, through the first and second auxiliary mixture supply passages 191 and 193, through the first and second mixture ports 181 and 183 in the cylinder walls 37 and 39, through the mixture supply ports 201 and 203 in the skirts 131 and 133 of the first and second pistons 121 and 123, and thus into the common crankcase 27 so as to provide additional fuel/air mixture to the crankcase 27. The auxiliary fuel supply system provides increased power output per unit volume of piston displacement.

It is noted that at least some of the advantages of the invention can be obtained when only one auxiliary carburetor, one auxiliary passage, and one set of fuel supply ports in one piston and the corresponding cylinder wall is employed.

If desired, the throttle valves 102 and 177 of the first primary and auxiliary carburetors 101 and 171 can be connected with a suitable, schematically shown, linkage 211 so that the auxiliary throttle valve 177 will open only at or near wide open throttle. In addition, the throttle valves 104 and 179 of the second primary and auxiliary carburetors 103 and 179 can be connected with a suitable, schematically shown, linkage 213 so that the auxiliary throttle valve 179 will open only at or near wide open throttle.

The engine 11 also includes a suitable, schematically shown, mechanism or device 215 which communicates with the crankcase 27 and which is operable to feed or deliver a calibrated amount of lubricating oil into the crankcase 27. Any suitable mechanism, driven by the engine in response to engine speed, or driven by a fuel pumping device supplying fuel to one or more of the carburetors, or other arrangement, can be employed.

In operation, the pistons 121 and 123 respectively and successively move through intake, compression, power, and exhaust strokes, in concert with movement of the rotary valves 117 and 119. Furthermore, the crank pins 91 and 93 are arranged so that both pistons 121 and 123 simultaneously travel in the same direction, and are arranged so that, for example, when the piston 121 is in the intake stroke, the piston 123 is in the power stroke, and visa versa.

Thus, when the piston 121 travels through the intake stroke from the top dead center position to the bottom dead center position, the associated combustion chamber 61 expands, and the associated rotary valve 117 is located so as to close the associated exhaust gas outlet passage 75, thereby preventing outflow from the combustion chamber 61, and so as to open the inlet passage 71, thereby affording inflow into the combustion chamber 61 of fuel/air mixture from the mixture passage 107 and the primary carburetor 101.

At the same time, the piston 123 travels through the power stroke from the top dead center position to the bottom dead center position, the associated combustion chamber 63 expands, and the associated rotary valve 119 is located to close both the associated inlet passage 73 and the associated exhaust gas outlet passage 77, thereby preventing inflow into the combustion chamber 63 of fuel/air mixture from the mixture passage 109 and the primary carburetor 103 and also preventing outflow from the combustion chamber 63.

Simultaneously, as the pistons 121 and 123 move from top dead center toward bottom dead center positions, the volume of the crankcase 27 under both pistons 121 and 123 diminishes, and the previously established communication between the mixture supply ports 181 and 183 in the cylinder walls 37 and 39 and the mixture supply ports 201 and 203 in the pistons 121 and 123 is discontinued, thereafter causing compression of the fuel/air mixture in the crankcase 27 as the volume thereof diminishes as the pistons 121 and 123 continue movement toward the bottom dead center positions. In addition, as the pistons 121 and 123 approach bottom dead center positions, the mixture transfer ports 167 and 169 in the pistons 121 and 123 come into communication with the mixture transfer ports 151 and 153 in the cylinder walls 37 and 39, thereby affording outflow from the crankcase 27 of the compressed fuel/air mixture through the mixture transfer port 167, through the branch mixture passage 157, through the mixture passage 107, past the associated rotary valve 117, and into the combustion chamber 61, causing increased pressure therein toward the end of the intake stroke of the piston 121.

In addition, as the pistons 121 and 123 approach bottom dead center, the exhaust gas discharge ports 141 and 143 are opened, thereby permitting outflow of the high pressure exhaust gases from the combustion chamber 63 through the exhaust gas discharge port 143, into the connecting passage 145, through the exhaust gas discharge port 141, and into the combustion chamber 61 so as to also increase the pressure therein.

Thereafter, the piston 121 travels in the compression stroke from the bottom dead center position to the top dead center position, the exhaust gas discharge port 141 is closed, and the rotary valve 117 is located so as to close both the associated inlet passage 71 and the associated exhaust gas outlet passage 75, thereby permitting compression of the fuel/air mixture in the combustion chamber 61.

At the same time, the piston 123 travels through the exhaust stroke from the bottom dead center position to the top dead center position, causing discharge of exhaust gas through the exhaust gas discharge port 143 from the combustion chamber 63, and the associated rotary valve 119 is located so as to open the exhaust gas outlet passage 77, thereby permitting discharge of exhaust gas from the combustion chamber 63, and so as to close the associated inlet passage 75, thereby preventing inflow of fuel/air mixture into the combustion chamber 63.

Simultaneously, as the pistons 121 and 123 move from the bottom dead center positions toward the top dead center positions, the volume of the crankcase 27 under both pistons 121 and 123 increases, and the previously established communication between the mixture transfer ports 151 and 153 in the cylinder walls 37 and 39 and the mixture transfer ports 167 and 169 in the pistons 121 and 123 is discontinued, whereby the pressure in the crankcase 27 diminishes as the crankcase 27 expands. In addition, as the pistons 121 and 123 approach the top dead center positions, the mixture supply ports 201 and 203 in the pistons 121 and 123 come into communication with the mixture supply ports 181 and 183 in the cylinder walls 37 and 39, thereby drawing fuel/air mixture into the expanded crankcase 27 from the auxiliary carburetors 171 and 173.

Thereafter, the piston 121 travels through the power stroke from the top dead center position to the bottom dead center position, the associated combustion chamber 61 expands, and the associated rotary valve 117 is located so as to close the associated inlet passage 71, thereby preventing inflow into the combustion chamber 61 of fuel/air mixture from the mixture passage 107 and the primary carburetor 101, and so as to close the exhaust gas outlet passage 77, thereby preventing outflow from the combustion chamber 61.

At the same time, the piston 123 travels through the intake stroke from the top dead center position to the bottom dead center position, the associated combustion chamber 63 expands, and the associated rotary valve 119 is located so as to open the associated inlet passage 73, thereby affording inflow into the combustion chamber 63 of fuel/air mixture from the mixture passage 109 and the primary carburetor 103, and so as to close the exhaust gas outlet passage 77, thereby preventing outflow from the combustion chamber 63.

Simultaneously, as the pistons 121 and 123 move from top dead center toward bottom dead center positions, the volume of the crankcase 27 under both pistons 121 and 123 diminishes, and the previously established communication between the mixture supply ports 181 and 183 in the cylinder walls 37 and 39 and the mixture supply ports 201 and 203 in the pistons 121 and 123 is discontinued, thereafter causing compression of the fuel/air mixture in the crankcase 27 as the volume thereof diminishes as the pistons 121 and 123 continue movement toward the bottom dead center positions. In addition, as the pistons 121 and 123 approach bottom dead center positions, the mixture transfer ports 167 and 169 in the pistons 121 and 123 come into communication with the mixture transfer ports 151 and 153 in the cylinder walls 37 and 39, thereby affording outflow from the crankcase 27 of the compressed fuel/air mixture through the mixture transfer port 169, through the branch mixture passage 159, through the mixture passage 109, past the rotary valve 119, and into the combustion chamber 63, causing increased pressure therein toward the end of the intake stroke of the piston 123.

In addition, as the pistons 121 and 123 approach bottom dead center, the exhaust gas discharge ports 141 and 143 are opened, thereby permitting outflow of the high pressure exhaust gases from the combustion chamber 61 through the exhaust gas discharge port 141, into the connecting passage 145, through the exhaust gas discharge port 143 and into the combustion chamber 63 so as to increase the pressure therein.

Thereafter, the piston 121 travels through the exhaust stroke from the bottom dead center position to the top dead center position, causing discharge of exhaust gas through the exhaust gas discharge port 141 from the combustion chamber 61, and locating the associated rotary valve 117 so as to open the associated exhaust gas passage 75, thereby permitting discharge of exhaust gas from the combustion chamber 61, and so as to close the associated inlet passage 71, thereby preventing inflow of fuel/air mixture into the combustion chamber 61.

At the same time, the piston 123 travels in the compression stroke from the bottom dead center position to the top dead center position, the exhaust gas discharge port 143 is closed, and the associated rotary valve 119 is located to close both the associated inlet passage 73 and the associated exhaust gas outlet passage 77, thereby permitting compression of the fuel/air mixture in the combustion chamber 63.

Simultaneously, the volume of the crankcase 27 under both pistons 121 and 123 increases, and as the pistons 121 and 123 move from the bottom dead center positions, the volume of the crankcase expands and the previously established communication between the mixture transfer ports 151 and 153 in the cylinder walls 37 and 39 and the mixture transfer ports 167 and 169 in the pistons 121 and 123 is discontinued, thereby lowering the pressure in the crankcase 27 as the crankcase 27 expands. In addition, as the pistons 121 and 123 approach the top dead center positions, the mixture supply ports 201 and 203 in the pistons 121 and 123 come into communication with the mixture supply ports 181 and 183 in the cylinder walls 37 and 39, thereby drawing fuel/air mixture into the expanded crankcase 27 from the auxiliary carburetors 171 and 173.

The disclosed construction thus provides the four-stroke internal combustion engine 11 with high power output per piston displacement because of the auxiliary fuel/air mixture supply system. Furthermore, the rotary valve arrangement employed in the cylinder heads of the disclosed four-stroke engine 11 requires little or no maintenance and is easy to manufacture. Still further the employment in the disclosed four-stroke engine 11 of the auxiliary exhaust system advantageously reduces the thermal loading on the rotary valves and also serves to advantageously increase the trapped charge in the combustion chambers at the beginning of compression.

Still further in addition, the employment in the disclosed four-stroke engine 11 of the fuel supply device 215 serves to provide a lubrication system which uses oil at a controlled rate, which eliminates the need for oil changes and an oil filter, while also providing or leaving a protective oil coating on the cylinder walls during non-use, and which permits employment of hardened needle bearings, thereby permitting employment of a smaller crankshaft due to the strength of the hardened material in the needle bearings.

Use of the rotary valves serves (a) to eliminate the need for adjusting lifters or hydraulic lifters which is important as a marine engine seldom benefits from preventative maintenance, (b) to permit construction from ground steel castings or lost foam castings, (c) to eliminate or reduce problems which are associated with excessive engine rotary speed which commonly occurs when marine engines are wave jumped, even with rpm limiters, and (d) to benefit from relatively simple assembly procedures.

Thus the disclosed construction allows the lubricating system to be of the two-stroke type which meters oil into the crankcase and which affords burn off the excess oil, as in a two-stroke engine. Since the fuel/air mixture does not primarily flow through the crankcase, the quantity of oil needed should be substantially less than in a two-stroke engine. By not "cleansing" the parts in the crankcase with fuel, the oil will "stay around" longer, further reducing the quantity of oil needed. Current two-stroke technology indicates that ratios as low as 150:1 are sufficient for bearing lubrication (with non-flow through the crankcase). Leaner ratios may be attainable with the disclosed construction.

Furthermore, the marine four-stroke engine 11 constructed in accordance with the disclosure offers the following advantages:

1. No need for an oil filter.

2. No need for oil changes which are particularly difficult on the water, especially on big boats.

3. Because marine engines tend to sit for long periods without use, start-up wear and friction on journal bearings used in four-stroke engines can be a problem. Use of the needle bearing assemblies disclosed herein avoids this problem.

4. Especially in cold weather, the disclosed construction reduces starting friction, thereby permitting use of a smaller starter motor.

5. In the disclosed construction, some lubrication is left on the cylinder bores, thereby helping prevent bore corrosion during storage, assuming that an oil scraper ring is not used.

6. Because a hardened crankshaft is much stronger, the size of the crankshaft can be smaller than a non-hardened crankshaft, which feature is always important on an outboard motor.

7. Needle bearings are less sensitive to block bending and distortion than are journal bearings.

8. The disclosed lubricating system is simpler than traditional, high pressure, four-stroke style systems.

9. Crankcase ventilation system is not necessary due to auxiliary intake constantly purging the crankcase with new air. Also, since the new oil is continually delivered to the engine, contaminated oil and sludge buildup, as sometimes occur in conventional four-stroke engines, are avoided.

10. Power losses due to friction are reduced.

Various of the features of the invention are set forth in the following claims.

We claim:

1. A cylinder block comprising a mounting surface having therein a crankcase cavity, and first and second cylinders respectively extending from said crankcase cavity in acute angular relation to each other and respectively including first and second cylinder walls respectively including first and second outer ends having respective first and second cylinder head mounting surfaces, and first and second mixture transfer ports, one of said first and second cylinder walls including a mixture supply port, first and second mixture supply passages respectively extending between said mounting surface and said first and second cylinder head mounting surfaces and respectively including first and second reed valves, a branch passage communicating between said mixture transfer port in said one of said cylinder walls and the corresponding one of said mixture supply passages at a location between the corresponding one of said first and second cylinder head mounting surfaces and the corresponding one of said first and second reed valves, and an auxiliary supply passage extending from said mounting surface and communicating with said mixture supply port in said one of said first and second cylinder walls.

2. A cylinder block comprising a mounting surface having therein a crankcase cavity, and first and second cylinders respectively extending from said crankcase cavity in acute angular relation to each other and respectively including first and second cylinder walls respectively including first and second outer ends having respective first and second cylinder head mounting surfaces, first and second mixture transfer ports, first and second mixture supply ports, and first and second exhaust gas discharge ports, a main exhaust gas discharge passage, a passage communicating between said first and second exhaust gas discharge ports and with said main exhaust gas discharge passage, first and second mixture supply passages respectively extending between said mounting surface and said first and second cylinder head mounting surfaces and respectively including first and second reed valves, first and second branch passages respectively communicating between said first and second mixture transfer ports in said cylinder walls and said first and second mixture supply passages at respective locations between said first and second cylinder head mounting surfaces and said first and second reed valves, and first and second auxiliary supply passages respectively extending from said mounting surface and communicating with said first and second mixture supply ports in said cylinder walls.

3. A cylinder block in accordance with claim 2 wherein said first and second mixture supply ports and said first and second mixture transfer ports are respectfully located in angularly spaced relation to each other and in axially spaced relation to each other.

* * * * *